US006777601B1

(12) United States Patent
Kerfoot

(10) Patent No.: US 6,777,601 B1
(45) Date of Patent: Aug. 17, 2004

(54) STRINGED MUSICAL INSTRUMENT SOUNDBOARD SYSTEM

(76) Inventor: Gregory L. Kerfoot, 957 Montiecello Dr., Naperville, IL (US) 60563

( * ) Notice: Subject to any disclaimer, the term of this patent is extended or adjusted under 35 U.S.C. 154(b) by 0 days.

(21) Appl. No.: 10/424,627

(22) Filed: Apr. 28, 2003

(51) Int. Cl.[7] ..... G10D 3/00
(52) U.S. Cl. ..... 84/291; 84/307
(58) Field of Search ..... 84/291, 290, 267, 84/307, 308, 309

(56) References Cited

U.S. PATENT DOCUMENTS

| | | | | |
|---|---|---|---|---|
| 3,964,362 A | * | 6/1976 | Quemore, Sr. | 84/173 |
| 4,016,793 A | | 4/1977 | Kasha | |
| 4,031,798 A | | 6/1977 | Sidner | |
| 4,090,427 A | | 5/1978 | Kaman | |
| 4,172,405 A | | 10/1979 | Kaman, II | |
| 4,178,827 A | | 12/1979 | Mallory | |
| 4,411,188 A | | 10/1983 | Gustavsson | |
| 4,873,909 A | | 10/1989 | Humphrey | |
| 4,903,567 A | | 2/1990 | Justus | |
| 5,347,905 A | | 9/1994 | Cipriani | |
| 5,461,958 A | | 10/1995 | Dresdner et al. | |
| 5,469,770 A | | 11/1995 | Taylor | |
| 5,644,094 A | | 7/1997 | Dickson, II | |
| 5,689,074 A | | 11/1997 | Penridge | |
| 5,804,746 A | | 9/1998 | Kersenbrock et al. | |
| 5,952,592 A | | 9/1999 | Teel | |
| 5,969,279 A | | 10/1999 | Dickson, II | |
| 6,103,961 A | | 8/2000 | Kaufman | |
| 6,107,552 A | | 8/2000 | Coomar et al. | |
| 6,124,536 A | | 9/2000 | Hoshino | |
| 6,166,308 A | | 12/2000 | Lam | |
| 6,188,005 B1 | | 2/2001 | White | |
| 6,265,648 B1 | | 7/2001 | Steinberger | |
| 6,610,915 B2 | * | 8/2003 | Schleske | 84/291 |
| 6,613,968 B1 | * | 9/2003 | Devereaux et al. | 84/299 |

OTHER PUBLICATIONS

Harry Fleishman, Shoptalk, Action Hero, "How To Make Adjustments To Your Truss Rod, Nut, and Saddle", www.acousticguitar.com, pp. 1–4.
www.guitartips.addr.com, Guitar Tip #52—High String Action, 1 page.
www.tranchant.freeserve.com.uk, "Lowering the Action", pp. 1–3.
www.custombasses.8m.com, Dr. Bob's Guitar and Bass Setup Tips, Action, Intonation, and Tuning, pp. 1–5.
www.mguitar.com, Martin Design Workshop Strikes a Chord with Guitar Enthusiasts, Annual Summer Class Planned, Released—Sep. 5, 2002, pp. 1–3.
Geoff Gehman, *Making Music*, The Morning Call (newspaper), Aug. 18, 2002, Section E, Pennsylvania.

* cited by examiner

*Primary Examiner*—Kimberly Lockett
(74) *Attorney, Agent, or Firm*—Banner & Witcoff, Ltd.

(57) ABSTRACT

A stringed musical instrument having two soundboards. A bridge is located between the two soundboards. The two soundboards tend to equalize any upward or downward pull by the bridge caused by the tension of the strings, thus lessening the tendency of the soundboard to bend, crack, or otherwise break or distort. It is not necessary for either soundboard to have a traditional sound hole. Instead, the two soundboards may be structured such that they form an internal J-baffle, giving the instrument an improved tone quality. The bridge may be easily removed and replaced with a replacement bridge that allows the use of strings having a different action. The instrument may include an arm cutout to allow the musician to maintain the same arm/string relationship as with traditional instruments.

12 Claims, 4 Drawing Sheets

STRINGED MUSICAL INSTRUMENT SOUNDBOARD SYSTEM

FIELD OF THE INVENTION

The present invention relates to a soundboard system for a stringed musical instrument and to stringed musical instruments having such a soundboard system. The invention has particular application where the stringed musical instrument is a guitar, though the invention has application to any stringed musical instrument.

BACKGROUND OF THE INVENTION

A stringed musical instrument typically has multiple strings strung at high tension from a nut to a bridge. Such an instrument has a single soundboard, typically with at least one sound hole. In a flat-top stringed musical instrument, such as a guitar, the high tension force of the strings constantly tends to pull the sound board up off of the instrument. In an arch-top stringed musical instrument, such as a violin, the high tension force of the strings constantly tends to push the soundboard down toward the back of the instrument. This force tends to cause the soundboard to bend, crack, or otherwise break or distort.

It is desirable to achieve greater sound volume from a stringed musical instrument. It is also desirable to achieve better tone quality from a stringed musical instrument, such as by producing sound that has a more complex texture or richer bass. To increase the sound volume, strings of a heavier gauge can be used. However, the use of heavier gauge strings increases the force on the soundboard, thus increasing the tendency for the string tension to cause the soundboard to break or distort.

The use of internal bracing on the underside of the soundboard is one way in which prior art designs have attempted to improve the strength and durability of the soundboard. For example, the following patents disclose different internal bracing patterns or structures for stringed musical instruments: U.S. Pat. No. 6,166,308 issued to Lam; U.S. Pat. No. 5,952,592 issued to Teel; U.S. Pat. No. 5,469,770 issued to Taylor; and U.S. Pat. No. 5,461,958 issued to Dresdner et al. However, the use of internal bracing can negatively affect tone quality. To reduce this negative effect on tone quality, bracing patterns may be complex and, thus, difficult and expensive to design and manufacture.

Another way in which prior art designs have attempted to improve the strength and durability of the soundboard is by making the soundboard of a non-conventional material. For example, U.S. Pat. No. 6,107,552 issued to Coomar et al. discloses a soundboard made from a composite structure with two layers of a stiffened graphite sheet material, with a low-density core material interposed between the two layers. The use of such a material may reduce the need for internal bracing. However, such a material may be expensive and time consuming to manufacture, and its use could adversely affect tone quality.

It is also desirable for a stringed musical instrument to allow the use of strings having different string action (i.e., string height). Different musicians may prefer to use strings having different action, based on personal preference. Different types of music also may lend themselves to strings having different action. In general, if the string action is too high, fingering may become difficult. If the string action is too low, the strings may buzz undesirably against frets on the finger board.

Prior art designs typically do not allow a musician to easily adjust the string action. Such adjustments typically cannot be made "on the fly." To lower the string action, it is typically necessary to shave or sand a saddle of the bridge. To raise the string action, it is typically necessary to shim the saddle. These adjustments typically must be done by a professional luthier and may be expensive and inconvenient.

SUMMARY OF THE INVENTION

The present invention is directed to a stringed musical instrument. In one embodiment of the invention, the stringed musical instrument is a guitar, having two soundboards. A bridge is located between the two soundboards. The two soundboards tend to equalize any upward or downward pull by the bridge caused by the tension of the strings, thus lessening the tendency of the soundboard to bend, crack, or otherwise break or distort. This embodiment of the invention allows the use of heavier gauge strings and higher string tension to produce a greater sound volume. This embodiment of the invention also reduces the need for internal bracing on the underside of the soundboards. This embodiment of the invention also allows the instrument to be constructed from conventional materials using conventional methods of construction.

In an embodiment of the invention, it is not necessary for either soundboard to have a traditional sound hole. Instead, the two soundboards of the invention may be structured such that they form an internal J-baffle. The J-baffle gives the instrument an improved tone quality, allowing it to produce sound having a more complex texture and richer bass.

An embodiment of the invention may allow for the bridge to be easily removed. The bridge may then be easily replaced with a replacement bridge that allows the use of strings having a different action. This removable and replaceable bridge allows a musician to change string action "on the fly," without the need for expensive and inconvenient professional adjustment.

An embodiment of the invention may also include an arm cutout. A right-handed player of a stringed musical instrument such as a guitar typically uses the point where his or her right arm touches the front of the instrument as a reference point to the strings. Similarly, a left-handed player typically uses the point where his or her left arm touches the front of the instrument as a reference point to the strings. The arm cutout maintains the same arm/string relationship as with traditional instruments. Both right-handed and left-handed embodiments having arm cutouts are possible.

DETAILED DESCRIPTION OF PREFERRED EMBODIMENTS

Figure 1:
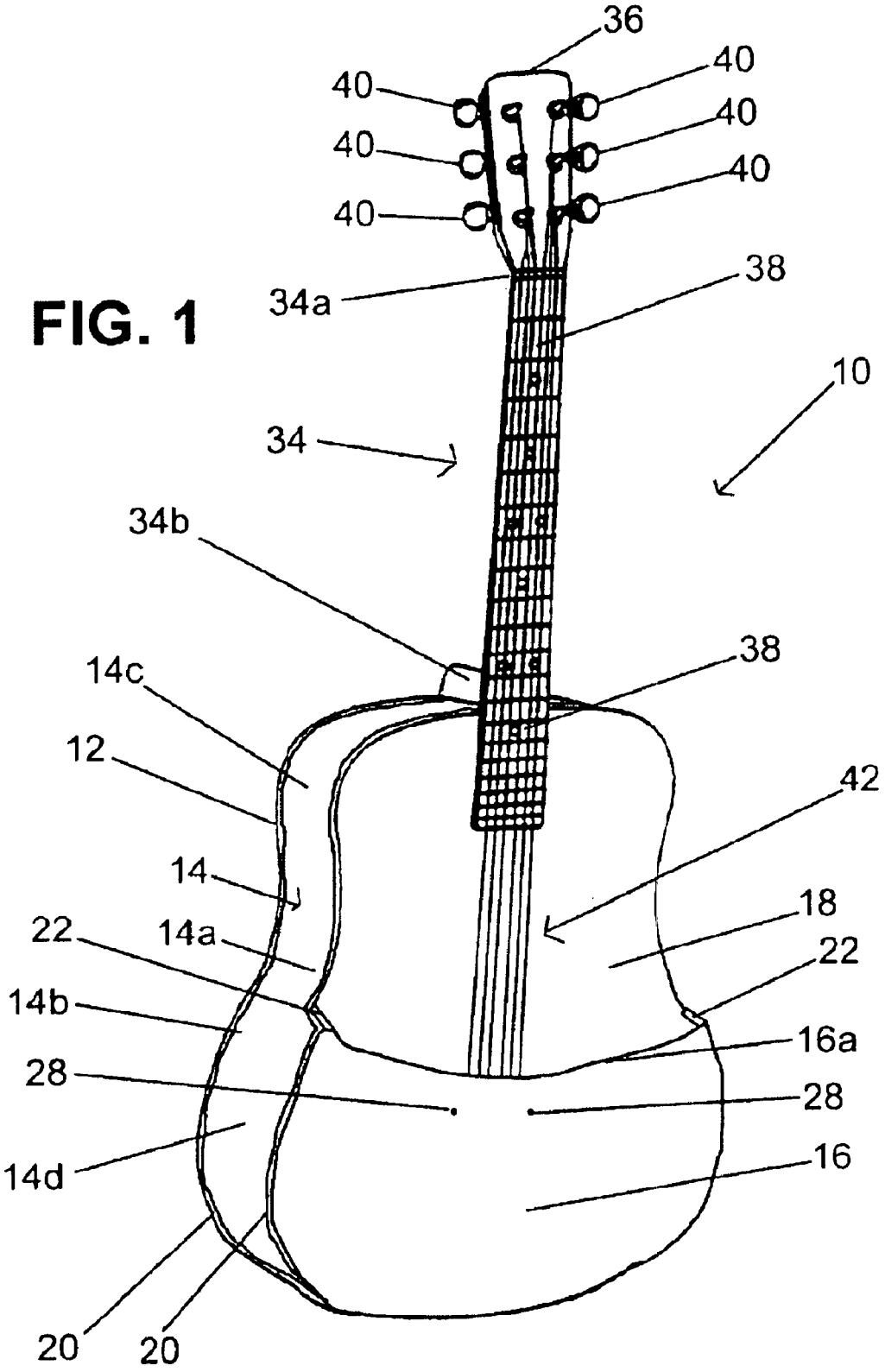
FIG. 1 is a plan view of an acoustic guitar constructed in accordance with one embodiment of the invention.
Figure 2:
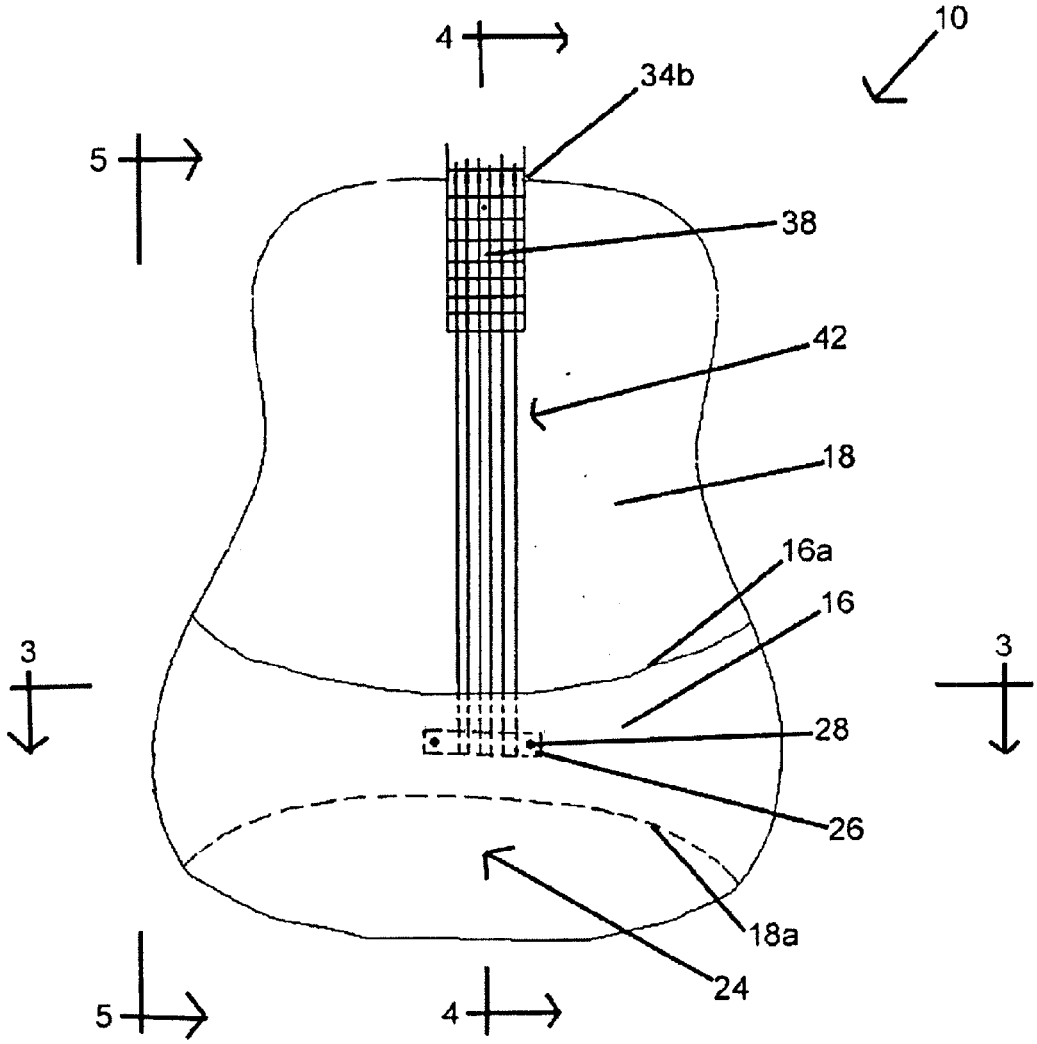
FIG. 2 is a partial top plan view of the acoustic guitar in FIG. 1.
Figure 4:
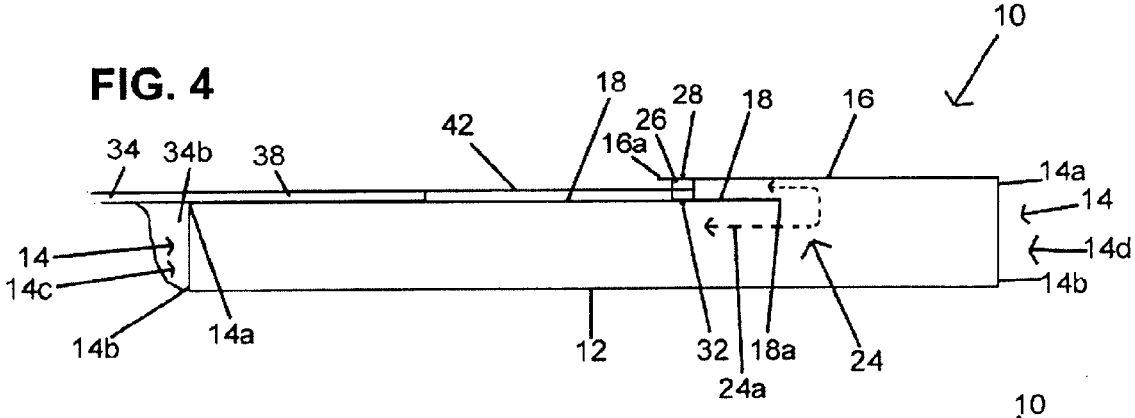
FIG. 4 is a cross-sectional view of the bridge, soundboards, and J-baffle of the acoustic guitar in FIG. 1 taken along line 4—4 of FIG. 2.
Figure 5:
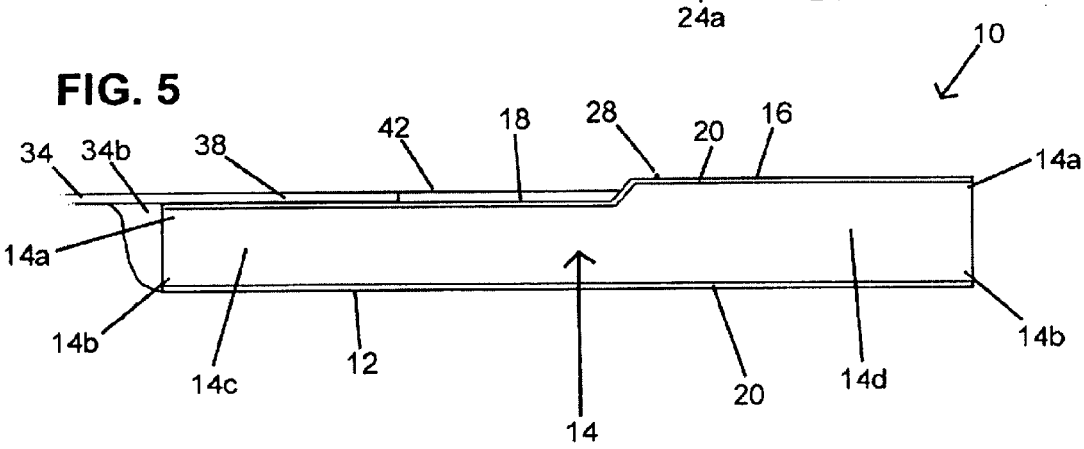
FIG. 5 is a partial side view of the acoustic guitar in FIG. 1 taken along line 5—5 of FIG. 2.

As can be seen in FIG. 1, in one embodiment, the stringed musical instrument is an acoustic guitar 10. Although the invention is discussed in conjunction with an embodiment where the stringed musical instrument is an acoustic guitar, after reading the description it will be apparent to those skilled in the art that the invention may be applied to other stringed musical instruments including, but not limited to, an acoustic-electric guitar, a banjo, a ukulele, a mandolin, a lute, a violin, a viola, a cello, and a double bass. As can be seen in FIGS. 1 and 5, the guitar 10 has a back 12 and a side 14, the side 14 having a top portion 14*a* and a bottom portion 14*b*. The back 12 is attached to the bottom portion 14*b* of the side 14. The side 14 also has a low portion 14*c* and a high portion 14*d*, such that the distance between the top portion 14*a* and the bottom portion 14*b* of the low portion 14*c* is less than the distance between the top portion 14*a* and the bottom portion 14*b* of the high portion 14*d*. As can be seen in FIGS. 1 and 4, a first soundboard 16 is attached to the top portion 14*a* of the high portion 14*d* of the side 14. A second soundboard 18 is attached to the top portion 14*a* of the low portion 14*c* of the side 14. As can be seen in FIG. 2, an unattached edge 16*a* of the first soundboard 16 may be curved upward, whereas an unattached edge 18*a* of the second soundboard 18 may be curved downward. Conventional internal side bracing may be used. Conventional internal bracing of the underside of the first soundboard 16 and the second soundboard 18 may be used, though the need for such bracing is eliminated or significantly reduced by the nature of the invention.

Each of the above-described attachments may be accomplished using conventional means such as an adhesive (e.g., glue), though other means of attachment may also be used. Alternatively, the attachments may be integral with the guitar 10. As can be seen in FIGS. 1 and 5, an optional binding 20 may be placed in a conventional manner to cover the attachment between: the back 12 and the bottom portion 14*b* of the side 14; the top portion 14*a* of the high portion 14*d* of the side 14 and the first soundboard 16; and the top portion 14*a* of the low portion 14*c* of the side 14 and the second soundboard 18. An optional filler 22 may be placed between the first soundboard 16 and the second soundboard 18 on each side of the unattached edge 16*a* of the first soundboard 16 adjacent to the side 14. The filler 22 may hide the internal portion of the guitar 10 from view for cosmetic reasons.

As can be seen in FIG. 4, the unattached edge 18*a* of the second soundboard 18 may extend below the first soundboard 16 several inches beyond the unattached edge 16*a* of the first soundboard 16. In such an embodiment, the first soundboard 16, the second soundboard 18, the back 12, and the side 14 form an internal J-baffle 24. The J-baffle 24 provides an air cavity, which appears like a letter "J" when viewed from the side, as indicated by a dashed line 24*a* in FIG. 4. The J-baffle 24 gives the instrument an improved tone quality, allowing it to produce sound having a more complex texture and richer bass. A traditional sound hole is thus not necessary, though the presence of one or more sound holes is not inconsistent with the invention.

Figure 3:
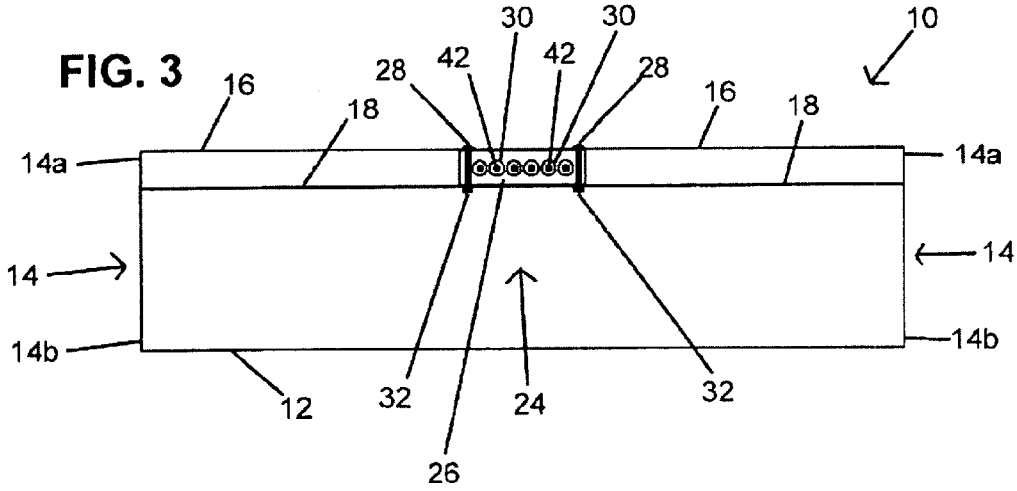
FIG. 3 is a cross-sectional view of the assembly of the bridge and soundboards of the acoustic guitar in FIG. 1 taken along line 3—3 of FIG. 2.

As can be seen in FIG. 3, a bridge 26 is disposed between the first soundboard 16 and the second soundboard 18. In one embodiment, the bridge 26 is attached between the first soundboard 16 and the second soundboard 18 using a pair of screws 28 and a pair of T-nuts 32. Each screw 28 passes from above the first soundboard 16 downward through the first soundboard 16 and through the bridge 26. Each T-nut 32 passes from below the second soundboard 18 upward through the second soundboard 18. Each screw 28 is threaded into each T-nut 32. The bridge 26 may also be attached to the first soundboard 16 and the second soundboard 18 using other techniques.

As can be seen in FIG. 1, in an embodiment of the invention, the guitar 10 further has a conventional neck 34, which has an upper end 34*a* and a lower end 34*b*. The lower end 34*b* of the neck 34 is attached to and extends from the low portion 14*c* of the side 14 in a conventional manner. A headstock 36 is connected to the upper end 34*a* of the neck 34. A plurality of tuning mechanisms 40 is disposed on the headstock 36. The tuning mechanisms 40 may be tuning machines, for example. A finger board 38 is mounted on the neck 34. The finger board 38 may extend beyond the lower end 34*b* of the neck 34 above the second soundboard 18. As can be seen in FIGS. 1 and 3, a plurality of strings 42 is strung between the tuning mechanisms 40 and the bridge 26. The strings 42 extend from the tuning mechanisms 40 and pass over the finger board 38, over the second soundboard 18, under the unattached edge of the first soundboard 16, and through a plurality of holes 30 in the bridge 26. The strings 42 are attached to the bridge 26 in a conventional manner. One embodiment of the invention has six strings 42, though any number may be used.

In one embodiment of the invention, the use of the screws 28 and the T-nuts 32 to attach the bridge between the first soundboard 16 and the second soundboard 18 allows the bridge 26 to be easily removed. The bridge 26 may then be easily replaced (for example, by a musician rather than a luthier) with a replacement bridge 26 that allows the use of strings 42 having a different action. The location of the holes 30 in the bridge 26 determines the action of the strings 42. Other means for attaching the bridge 26 to the first soundboard 16 and the second soundboard 18 may also be used to allow the bridge 26 to be easily removed and replaced.

Figure 6:
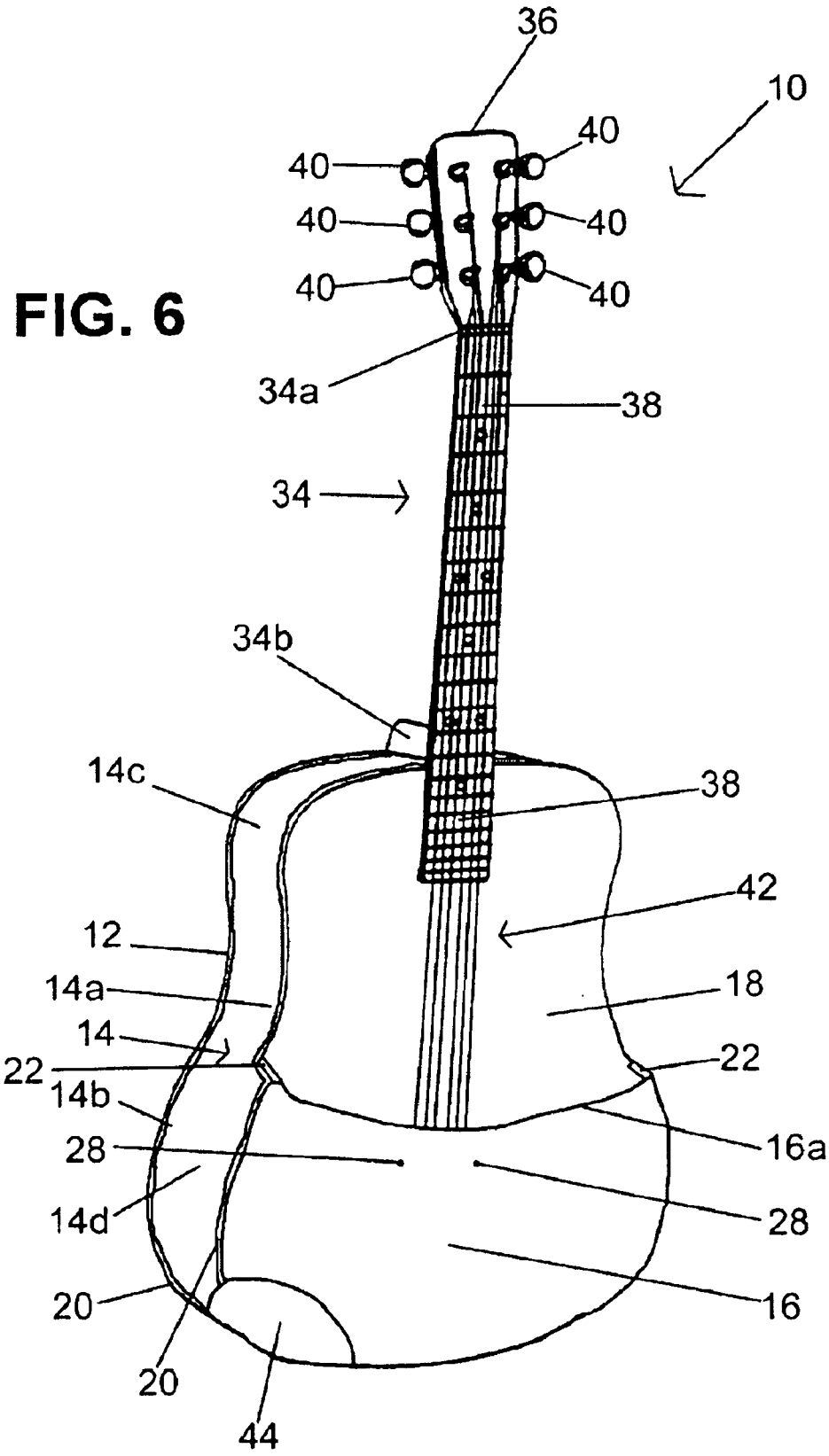
FIG. 6 is a plan view of an acoustic guitar constructed in accordance with a further embodiment of the invention, which includes a right-handed arm cutout.

As can be seen in FIG. 6., in a further embodiment of the invention, the first soundboard 16 may include an arm cutout 44. The arm cutout 44 allows a musician to maintain the same arm/string relationship as with traditional instruments.

Although the invention has been described in terms of certain embodiments, other embodiments that are apparent to those of ordinary skill in the art after reading the description are also within the scope of the invention. Thus, the scope of the invention is intended to be defined only by the following claims.

I claim:

1. A stringed musical instrument, comprising:

a) a first soundboard;

b) a second soundboard spaced from the first soundboard; and c) a bridge disposed between the first soundboard and the second soundboard, wherein the first soundboard and the second soundboard tend to equalize any upward or downward pull by the bridge.

2. The stringed musical instrument of claim 1, wherein the stringed musical instrument is a guitar.

3. The stringed musical instrument of claim 1, wherein the first soundboard further comprises an arm cutout.

4. The stringed musical instrument of claim 1, wherein the second soundboard extends below the first soundboard, the first soundboard and the second soundboard forming a J-baffle.

5. The stringed musical instrument of claim 1, wherein the bridge is removable.

6. The stringed musical instrument of claim 5, wherein the bridge may be replaced with a replacement bridge adapted for use with strings having a different action.

7. A stringed musical instrument, comprising:

a) a back;

b) a side having a top portion and a bottom portion, the bottom portion of the side being attached to the back;

c) a first soundboard disposed on the top portion of the side;

d) a second soundboard disposed on the top portion of the side, the second soundboard being spaced from the first soundboard; and e) a bridge disposed between the first soundboard and the second soundboard, wherein the second soundboard extends below the first soundboard, the first soundboard, the second soundboard, the back, and the side forming a J-baffle.

8. A stringed musical instrument, comprising:

a) a back;

b) a side having a top portion and a bottom portion, the bottom portion of the side being attached to the back, the side further having a high portion and a low portion, the top portion of the high portion of the side extending farther from the back than the top portion of the low portion of the side extends;

c) a first soundboard disposed on the top portion of the high portion of the side;

d) a second soundboard disposed on the top portion of the low portion of the side, the second soundboard extending below the first soundboard, the first soundboard, the second soundboard, the back, and the side forming a J-baffle;

e) a bridge disposed between the first soundboard and the second soundboard;

f) a neck having an upper end and a lower end, the lower end of the neck being attached to and extending from the low portion of the side;

g) a headstock connected to the upper end of the neck;

h) a plurality of tuning mechanisms disposed on the headstock;

i) a finger board mounted on the neck, the finger board extending beyond the neck above the second soundboard; and j) a plurality of strings strung between the plurality of tuning mechanisms and the bridge.

9. The stringed musical instrument of claim 8, wherein the stringed musical instrument is a guitar.

10. The stringed musical instrument of claim 8, wherein the first soundboard further comprises an arm cutout.

11. The stringed musical instrument of claim 8, wherein the bridge is removable.

12. The stringed musical instrument of claim 11, wherein the bridge may be replaced with a replacement bridge adapted for use with strings having a different action.

* * * * *